US006959505B2

(12) United States Patent
Poe

(10) Patent No.: US 6,959,505 B2
(45) Date of Patent: Nov. 1, 2005

(54) ELASTOMERIC, ENERGY MANAGEMENT CUSHION

(76) Inventor: Charles A. Poe, 1815 W. Madison Ave., Athens, TN (US) 37303

( * ) Notice: Subject to any disclaimer, the term of this patent is extended or adjusted under 35 U.S.C. 154(b) by 0 days.

(21) Appl. No.: 10/321,934

(22) Filed: Dec. 17, 2002

(65) Prior Publication Data

US 2003/0121180 A1 Jul. 3, 2003

Related U.S. Application Data

(60) Provisional application No. 60/346,424, filed on Dec. 29, 2001.

(51) Int. Cl.[7] ..... A43B 13/38; A43B 23/00; A43B 13/18; A43B 1/06; A61F 5/14

(52) U.S. Cl. ..... 36/43; 36/28; 36/88; 36/141

(58) Field of Search ..... 36/43, 44, 28, 36/30 R, 88, 141

(56) References Cited

U.S. PATENT DOCUMENTS

| | | | | | |
|---|---|---|---|---|---|
| 4,179,826 | A | | 12/1979 | Davidson | |
| 4,180,923 | A | * | 1/1980 | Dassler | 36/32 R |
| 4,445,286 | A | * | 5/1984 | Norton | 36/32 R |
| 4,506,461 | A | | 3/1985 | Inohara | |
| 4,541,184 | A | | 9/1985 | Leighton | |
| 4,619,056 | A | | 10/1986 | Lin | |
| 4,642,917 | A | * | 2/1987 | Ungar | 36/59 C |
| D288,621 | S | | 3/1987 | Surpuriya | |
| 4,685,224 | A | | 8/1987 | Anger | |
| 4,760,655 | A | | 8/1988 | Mauch | |
| 4,831,749 | A | | 5/1989 | Tsai | |
| 4,879,821 | A | | 11/1989 | Graham | |
| D305,954 | S | | 2/1990 | Kin | |
| 4,897,937 | A | | 2/1990 | Misevich | |
| 4,910,882 | A | * | 3/1990 | Goller | 36/141 |
| D307,072 | S | | 4/1990 | Graham | |
| 4,977,691 | A | | 12/1990 | Orchard | |
| 5,063,692 | A | | 11/1991 | Suginaka | |
| 5,067,256 | A | | 11/1991 | Darby | |
| D342,374 | S | | 12/1993 | Wang | |
| D350,848 | S | | 9/1994 | Tzenos | |
| 5,400,526 | A | * | 3/1995 | Sessa | 36/141 |
| 5,517,770 | A | | 5/1996 | Martin | |
| 5,553,398 | A | | 9/1996 | Schnewlin-Maier | |
| 5,581,913 | A | * | 12/1996 | Kataoka et al. | 36/134 |
| 5,607,749 | A | | 3/1997 | Strummer | |
| 5,638,613 | A | | 6/1997 | Williams | |
| 5,664,342 | A | | 9/1997 | Buchsen Schuss | |
| 5,694,705 | A | | 12/1997 | Coves | |
| 5,735,804 | A | | 4/1998 | Chan | |
| 5,815,949 | A | * | 10/1998 | Sessa | 36/28 |
| 5,853,844 | A | | 12/1998 | Wen | |
| 5,894,687 | A | | 4/1999 | Lin | |
| 5,946,824 | A | * | 9/1999 | Tighe et al. | 36/28 |

(Continued)

FOREIGN PATENT DOCUMENTS

| | | | | |
|---|---|---|---|---|
| DE | 3635831 A1 | * | 5/1988 | A43B 13/14 |

(Continued)

*Primary Examiner*—Anthony Stashick

(57) ABSTRACT

The invention is an elastomeric, energy-management cushion formed of at least one or more spaced, expandable, geometrically shaped cushioning elements disposed in a pattern on supporting base. The cushioning elements each have a plurality of angularly spaced projections, the projections of each cushioning element being interspersed between and spaced from the projections of the adjacent cushioning elements. The interspersed projections absorb and distribute compression forces applied to the cushioning elements as triangulated vector forces within the projections forming the respective cushioning elements, to which the compression forces are applied thereby providing an elastomeric, energy-management cushion.

10 Claims, 2 Drawing Sheets

U.S. PATENT DOCUMENTS

| | | | | |
|---|---|---|---|---|
| D423,765 | S | 5/2000 | Autry | |
| 6,065,229 | A * | 5/2000 | Wahrheit | 36/30 R |
| 6,219,941 | B1 | 4/2001 | Kukoff | |
| 6,301,805 | B1 | 10/2001 | Howlett | |

FOREIGN PATENT DOCUMENTS

| | | | | |
|---|---|---|---|---|
| EP | 0295219 A2 * | 12/1988 | ..... | A43B 13/18 |
| EP | 0359699 A1 * | 3/1990 | ..... | A43B 23/00 |

* cited by examiner

ELASTOMERIC, ENERGY MANAGEMENT CUSHION

RELATED US APPLICATION DATA

This application claims the benefit of Provisional Application No. 60/346,424 filed Dec. 29, 2001.

BACKGROUND OF THE INVENTION

Elastomeric, energy management cushions for use in shoe insoles and other protective wear products such as helmets, chest protectors, seat cushions, and automotive safety panels are generally known. Typically, such shock absorbing cushions are elastomeric molded of a thermoplastic composition to form honeycomb cells having relatively thin intersecting ribs or of spaced solid projections that extend from a supporting base. Conventional shock absorbing cushions are limited to the compression forces the respective cushioning elements can absorb before crushing or collapsing and bottoming out at which time they have little or no further cushioning effect. Thus there is no interactive, energy management within or between the honeycomb cells or spaced projections forming the respective cushioning elements.

Accordingly, it is an object of this invention to provide an elastomeric, energy-management cushion formed of one or more geometrically shaped cushioning elements interspersed to absorb and distribute applied compression forces within and between the respective cushioning elements thereby forming an elastomeric, energy management cushion.

SUMMARY OF THE INVENTION

The invention is an elastomeric, energy management cushion formed of one or more geometrically shaped cushioning elements that may be molded with or otherwise affixed to a supporting base. Each cushioning element includes a plurality of expandable, angularly spaced projections that conform to while absorbing and distributing applied compression forces as triangulated vector forces within the angularly spaced projections of each cushioning element. The angularly spaced projections of each cushioning element are interspersed with and spaced from the angularly spaced projections of adjacent cushioning elements to absorb and distribute the applied compression forces within and between the adjacent cushioning elements, thereby providing an elastomeric, energy management cushion.

BRIEF DESCRIPTION OF THE DRAWINGS

Numerous other objects and advantages of the invention should become apparent from the following detailed description when read in the view of the accompanying drawings wherein.

BRIEF DESCRIPTION OF THE INVENTION

Figure 1:
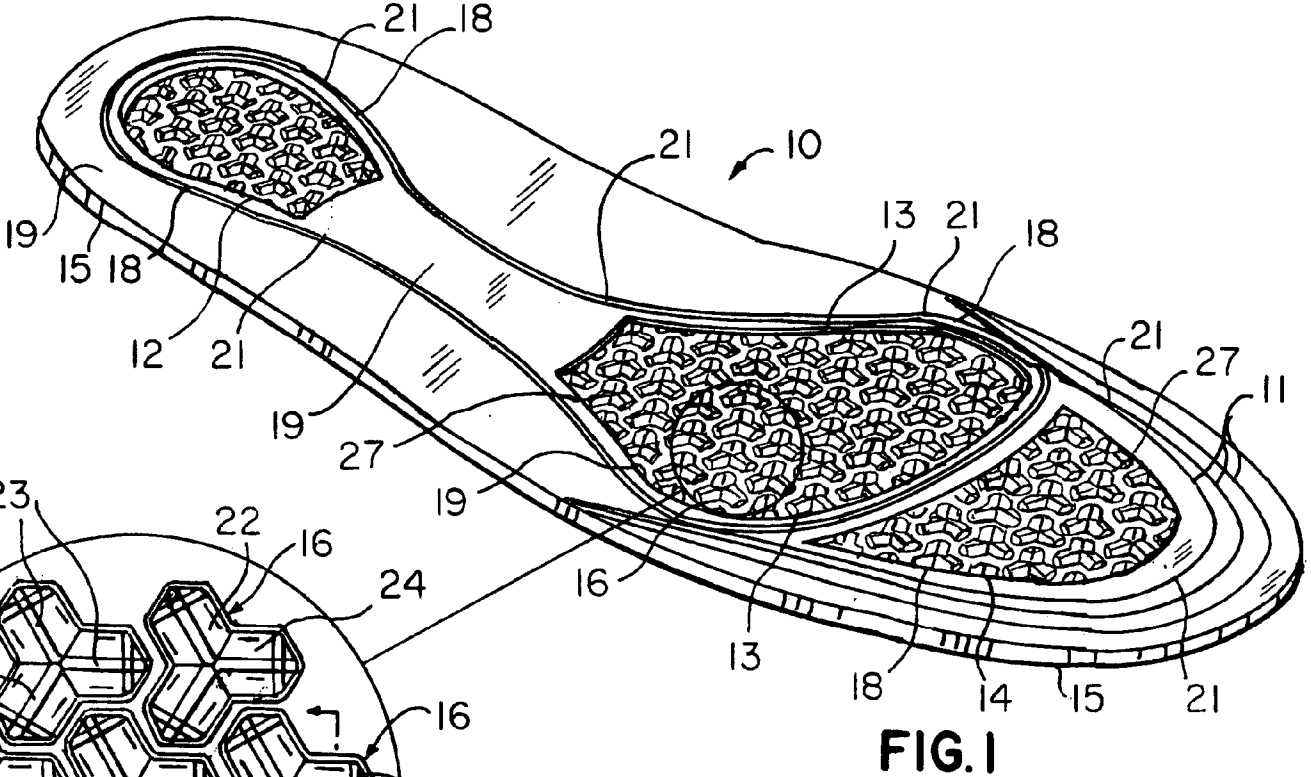
FIG. 1 is perspective plan view of the bottom surface of an elastomeric shoe insole having heel, ball of the foot, and metatarsal cushions formed of interspersed, geometrically shaped cushioning elements in accordance with a preferred embodiment of the invention.

Referring to the drawings, FIG. 1 illustrates a preferred embodiment of the invention used in a removable shoe insole designated generally by reference numeral 10. The insole 10 may be molded of a suitable, elastomeric, gelatinous, thermoplastic composition formed of an admixture of a commercially available SEPS Triblock Polymer and plasticizing oil to provide a moldable gel of selective elongation, tensile strength, and elastic shape retention or memory after deformation or expansion by an applied compression force or weight.

As is known, such elastomeric thermoplastic compositions may have a range of rigidity or hardness depending upon the cushioning effect desired which is determined by the size and shape of the molded insole. The aforementioned properties of the elastomeric composition used, and the applied compression forces to be managed or absorbed and distributed by the molded insole.

While a preferred embodiment of the invention is described for use in a removable shoe insole 10, the invention may find application in shoe foot beds, football and other protective helmets, orthopedic devices and automotive energy management panels.

The insole 10 is shaped in the form of a foot and provided with trim lines 11 so that it may be trimmed for use with different sized shoes. The insole 10 may be provided with three elastomeric, energy management cushions 12, 13, and 14 in accordance with the invention at the heel, ball of the foot, and metatarsal or toe portions respectively of the insole 10. The top surface of the insole 10 may be covered with a suitable fabric cover 15.

Cushions 12, 13, and 14 are formed of spaced, expandable, geometrically shaped cushioning elements 16 integrally formed on and that extend from the base 17 of cavities 18 in lower surface 19 or insole 10. The cushioning elements 16 are interspersed to form a pattern providing a cushioning surface area of the size required for the desired effect. Each cavity 18 is defined by an encircling wall 21 spaced from the exterior cushioning elements 16 forming each cushion 12, 13 and 14.

The cavity 18 at the heel cushion 12 maybe deeper (0.120 thousandths of an inch for example) than the cavities 18 of cushions 13 and 14 (0.050 thousandths of an inch for example) to accommodate the greater compression forces applied to the heel cushion 12 during use.

Figure 2:
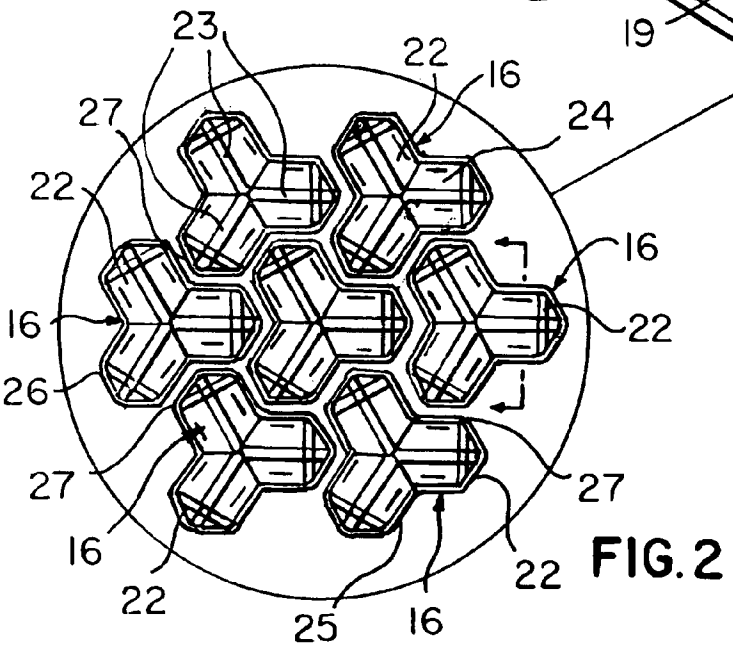
FIG. 2 is an enlarged, partial plan view of a plurality of interspersed, geometrically shaped cushioning elements shown in FIG. 1.
Figure 3:
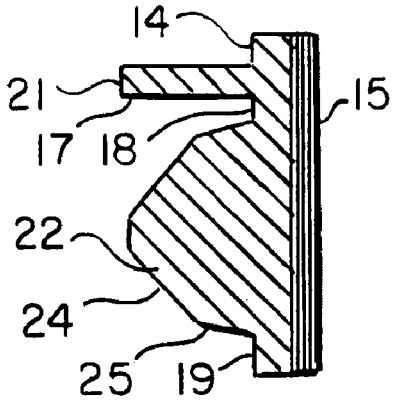
FIG. 3 is a sectional view of a projection of a geometrically shaped cushioning element affixed to a base taken along lines 3—3 in FIG. 2.

As illustrated in FIGS. 1–3, a preferred geometric shape of the cushion elements 16 in accordance with the invention is formed of three angularly spaced triangular projections 22, the longitudinal axis 23 of the projections 22 intersecting at the center of the cushioning element 16. The projections 22 extend parallel with the base 17 of cavities 18 and each are formed of spaced sidewalls 25, a top surface 24 and ends 26.

The height of the projections 22 is equal to the depth of the cavities preferably. Energy management can also be achieved by increasing the height and thus the size of projections 22 forming the geometrically shaped cushioning elements 16. This provides additional energy absorbing elastomeric gel material.

The angularly spaced projections 22 conform to applied compression forces expanding in surface area along the longitudinal axis of the respective projections while vectoring or triangulating and distributing the applied compression forces to 90 degrees of the direction of the applied forces. The projections 22 return to their normal size when compression forces are removed. The width cross-section of the channels 27 is determined by the shape of the sidewalls of the adjacent spaced projections 22 of the cushioning elements 16.

The angularly spaced projections 22 of the cushioning elements 16 are interspersed and spaced forming the channel 27 around adjacent cushioning elements 16. The channel 27 prevents each cushioning element 16 from completely bottoming out or going solid, closing any further cushioning effect, until both sidewalls 25 of each projection 22 of each cushioning element fully engages a sidewall 25 of spaced projections 22 of an adjacent cushioning element 16.

This provides energy management within and between adjacent cushioning elements 16 while reducing by absorbing and distributing the maximum compression forces from where applied to one or more adjacent cushioning elements 16.

Figure 4:
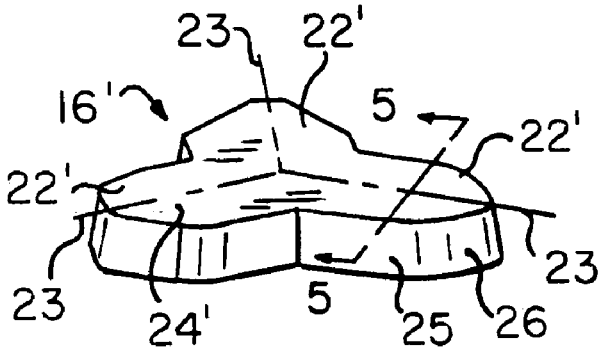
FIG. 4 is a plan view of an alternative embodiment of a geometrically shaped cushioning element, the cushioning element being formed of angularly spaced, rectangularly shaped projections having a flat upper surface, triangularly shaped ends and partially inclined sidewalls.
Figure 5:
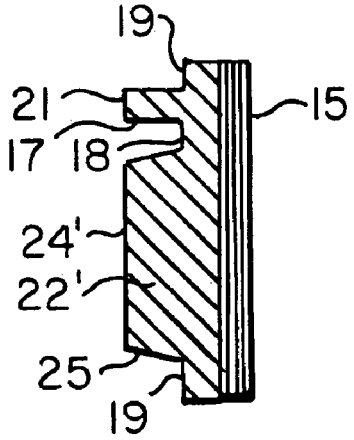
FIG. 5 is a cross-sectional view of a cushioning element projection taken along the line 5—5 in FIG. 4.
Figure 6:
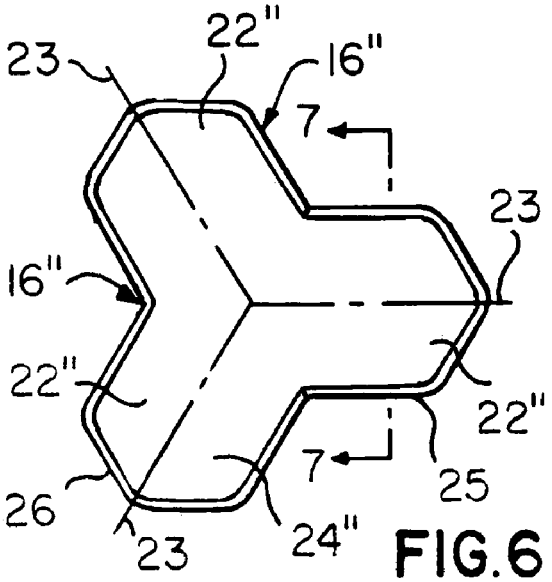
FIG. 6 is a plan view of yet another embodiment of a geometrically shaped cushioning element formed of angularly spaced projections having a curved upper surface.
Figure 7:
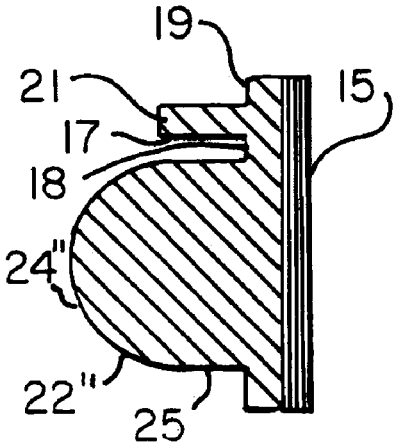
FIG. 7 is cross-sectional view of a projection taken along the line 7—7 in FIG. 6.

FIGS. 4 and 5 and FIGS. 6 and 7 illustrate alternative embodiments of geometrically shaped elements 16' and 16" respectively, for practicing the invention. The top surface 24' of each projection 22' may be flat as shown in FIGS. 4 and 5 or the top surface 24" of each projection 22 " may be semi-circular as shown in FIGS. 6 and 7.

While the invention has been described as a cushion for use with insoles, it is understood the invention may be used to provide cushions for numerous other articles that absorb and distribute compression forces such as safety helmets, protective sports and orthopedic pads.

What is claimed is:

1. A shoe insole including one or more elastomeric, energy-management cushions molded of a gelatinous, thermoplastic resin on a lower surface of the insole, each of said energy management cushions comprising:

a plurality of angularly spaced, geometrically shaped cushioning elements arranged in a pattern on the lower surface of said insole, each cushioning element being formed of multiple, angularly spaced and expandable projections, the projections of each of said cushioning elements, being interspersed between and spaced from the projections of adjacent cushioning elements, said interspersed projections absorbing and distributing compression forces applied to said cushion by a wearer of said insole as triangulated vector forces within and between the cushioning elements to which the compression forces are applied, thereby providing an insole with an elastomeric, energy management cushion.

2. The invention as defined in claim 1 wherein each spaced projection is provided with a top surface.

3. The invention as defined in claim 1 wherein said insole includes three of said elastomeric, energy-management cushions at the heel, ball of foot, and metatarsal areas respectively of said insole, said spaced projections extending from the bottom of cavities formed in said insole, the height of said spaced projections equaling the depth of said cavities.

4. The invention as defined in claim 1 wherein said spaced interspersed projections form channels around said adjacent cushioning elements.

5. The invention as defined in claim 1 wherein said top surface of each projection is triangular shaped.

6. The invention as defined in claim 1 wherein the top surface of each projection is semicircular.

7. The invention as defined in claim 2 wherein said top surface is flat.

8. The invention as defined in claim 5 wherein a portion of said triangular shaped top surface is flat.

9. The invention as defined in claim 3 wherein the height of said projections is greater than the depth of one or more of said cavities.

10. In an elastomeric, energy management cushion formed of a plurality of geometrically shaped cushioning elements the improvement wherein each cushioning element is provided with a plurality of expandable, angularly spaced projections wherein said spaced projections form channels around said adjacent cushioning elements, said spaced projections absorbing and distributing compression forces applied thereto as triangulated vector forces within said adjacent cushioning elements.

* * * * *